US007816872B2

(12) United States Patent
Nerone et al.

(10) Patent No.: US 7,816,872 B2
(45) Date of Patent: Oct. 19, 2010

(54) DIMMABLE INSTANT START BALLAST

(75) Inventors: Louis R. Nerone, Brecksville, OH (US); Melvin C. Cosby, Jr., Grand River, OH (US)

(73) Assignee: General Electric Company, Schenectady, NY (US)

( * ) Notice: Subject to any disclaimer, the term of this patent is extended or adjusted under 35 U.S.C. 154(b) by 335 days.

(21) Appl. No.: 12/040,216

(22) Filed: Feb. 29, 2008

(65) Prior Publication Data

US 2009/0218953 A1 Sep. 3, 2009

(51) Int. Cl.
*H05B 37/02* (2006.01)

(52) U.S. Cl. ..... 315/224; 315/276; 315/284

(58) Field of Classification Search ..... 315/200 R, 315/209 R, 219, 224, 274, 276, 283–284, 315/291, DIG. 4
See application file for complete search history.

(56) References Cited

U.S. PATENT DOCUMENTS

| | | | | |
|---|---|---|---|---|
| 5,049,790 | A * | 9/1991 | Herfurth et al. | 315/291 |
| 5,619,106 | A * | 4/1997 | Secen | 315/290 |
| 6,215,255 | B1 * | 4/2001 | Kim et al. | 315/291 |
| 6,362,575 | B1 * | 3/2002 | Chang et al. | 315/224 |
| 6,693,396 | B1 * | 2/2004 | Hsu | 315/291 |
| 6,815,908 | B2 | 11/2004 | Glaser et al. | |
| 7,030,568 | B2 * | 4/2006 | Boke et al. | 315/224 |
| 2004/0130273 | A1 * | 7/2004 | Alexandrov | 315/291 |
| 2007/0176564 | A1 | 8/2007 | Nerone et al. | |
| 2008/0211423 | A1 * | 9/2008 | Shinmen et al. | 315/259 |

FOREIGN PATENT DOCUMENTS

| | | |
|---|---|---|
| EP | 0 340 049 | 11/1989 |
| EP | 0 479 352 | 4/1992 |

OTHER PUBLICATIONS

PCT/US2009/032170 International Search Report, mailed Apr. 1, 2009.

* cited by examiner

*Primary Examiner*—Douglas W Owens
*Assistant Examiner*—Tung X Le
(74) *Attorney, Agent, or Firm*—Fay Sharpe LLP

(57) ABSTRACT

In an instant start ballast, dimming control is provided over a range of operation in which lamps driven by the ballast do not require external cathode heating. An interface circuit (92) includes a winding (90) that is inductively coupled to windings (68, 70) of an inverter circuit (12). The interface circuit (92) also includes a variable impedance in parallel with the winding (90) where the variable impedance includes a transistor (96) and a Zener diode (98). By varying an input voltage across control leads (94), the apparent inductance of the winding (90) is varied. This variance affects the switching frequency of the inverter circuit (12) affecting the frequency of a drive signal provided to the lamps. Thus the instant start ballast can be dimmed without use of multiple ballasts and/or external cathode heating.

10 Claims, 3 Drawing Sheets

DIMMABLE INSTANT START BALLAST

This application relates to currently pending U.S. application Ser. No. 11/343,335 to Nerone, et al., which is hereby incorporated by reference in its entirety.

BACKGROUND

The present application relates to electronic lighting. More specifically, it relates to a dimmable electronic ballast and will be described with particular reference thereto. It is to be appreciated that the present ballast can also be used in other lighting applications, and is not limited to the aforementioned application.

In the past, dimmable ballast systems have typically been composed of multiple discrete ballasts. In order to achieve a lower light output, one or more of the ballasts would be shut off. Conversely, when greater light output is desired, more ballasts are activated. This approach has the drawback of only being able to produce discrete levels of light output. With each ballast only able to produce a single light output, the aggregate output is limited to what the various combinations of the ballasts present can produce. Moreover, this setup also requires multiple lamps for the same space to be lighted, resulting in an inefficient use of space.

Another approach in dimmable lighting applications has been to dim a single ballast by varying the operating voltage of the ballast, that is, by varying the voltage of the high frequency signal used to power the lamp. One drawback in such a system is that as the voltage of the high frequency signal is diminished, the lamp cathodes cool down. This can lead to the lamp extinguishing, and unnecessary damage to the cathodes. To avoid this problem, such systems apply an external cathode heating. While this solves the problem of premature extinguishing, the ballast is drawing power that is not being used to power the lamp. This decreases the overall efficiency of the ballast.

The present application contemplates a new and improved dimmable electronic ballast that overcomes the above-referenced problems and others.

BRIEF DESCRIPTION

In accordance with one aspect, a dimming instant start lighting ballast circuit is provided. First and second switches receive a direct current and convert it to an alternating current and provide the alternating current to at least one lamp. A first inductive winding is connected between the gate and source of the first switch. A second inductive winding is connected between the gate and source of the second switch. A resonant portion determines an operating frequency of the ballast. An interface circuit receives an input and controls the light output of the at least one lamp.

In accordance with another aspect, a method of dimming a fluorescent lamp with an instant start ballast is provided. A DC signal is provided to the ballast. The DC signal is converted into an AC signal. The AC signal is provided to power at least one lamp. The frequency of the AC signal to the at least one lamp is varied with an interface circuit.

In accordance with another aspect, an interface circuit for dimming an instant start ballast is provided. A control winding interfaces with the ballast. A variable impedance in parallel with the control winding changes the apparent inductance of the control winding. Control leads for inputting a control signal that changes the conductivity of the variable impedance are included. A Zener diode provides startup protection. A rectifier converts an AC signal to a DC signal. Smoothing circuitry smoothes the DC signal.

DETAILED DESCRIPTION

Figure 1:
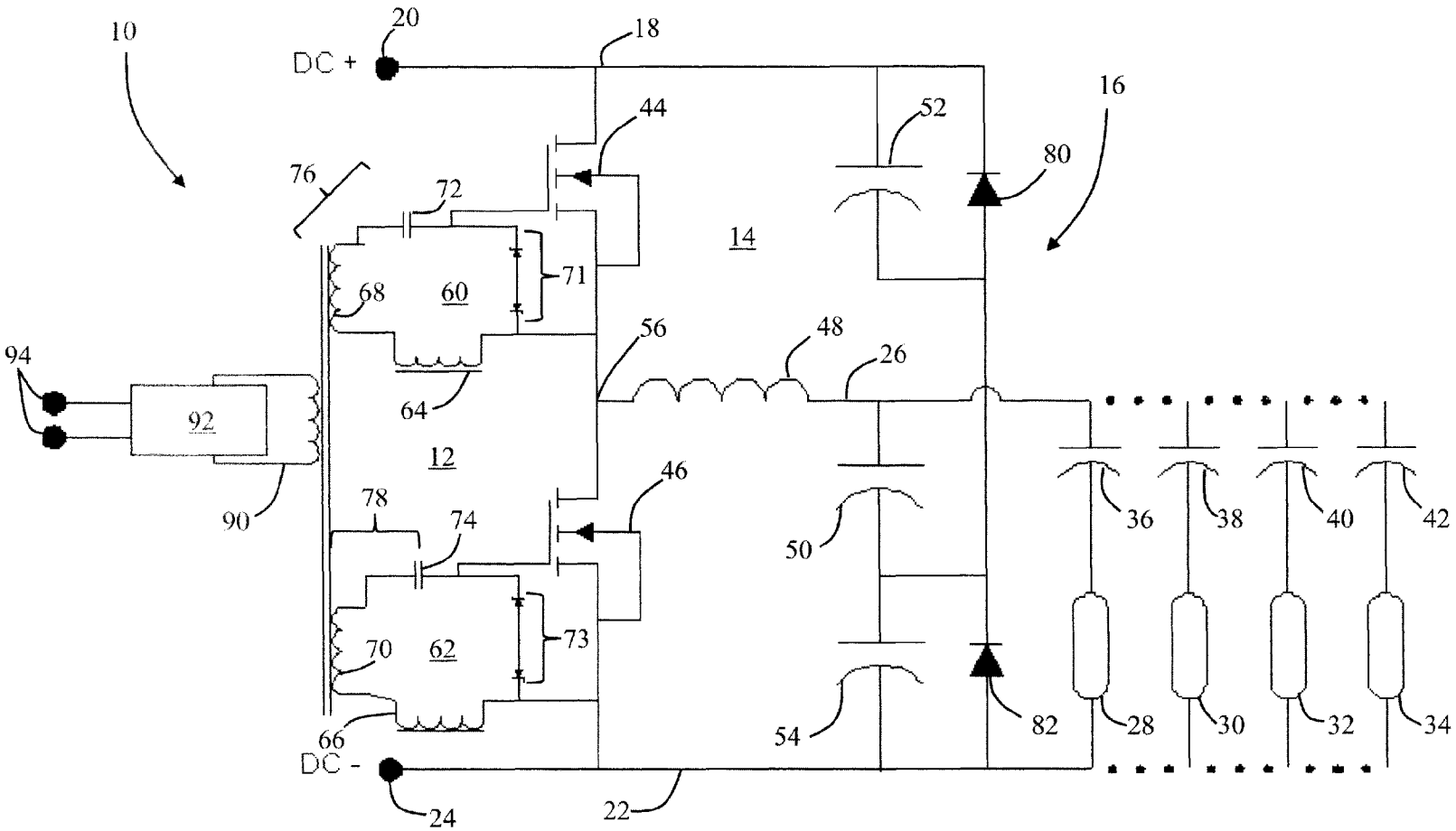
FIG. 1 is a circuit diagram of a dimmable instant start electronic ballast, in accordance with the present application.

With reference to FIG. 1, a ballast circuit 10, such as an instant start ballast, includes an inverter circuit 12 resonant circuit or network 14, and a clamping circuit 16. A DC voltage is supplied to the inverter 12 via a positive bus rail 18 running from a positive voltage terminal 20. The circuit 10 completes at a common conductor 22 connected to a ground or common terminal 24. A high frequency bus 26 is generated by the resonant circuit 14 as described in more detail below. First, second, third, through $n^{th}$ lamps 28, 30, 32, 34 are coupled to the high frequency bus 26 via first, second, third, and $n^{th}$ ballasting capacitors 36, 38, 40, 42. Thus, if one lamp is removed, the others continue to operate. It is contemplated that any number of lamps can be connected to the high frequency bus 26. E.g., lamps 28, 30, 32, 34 are coupled to the high frequency bus 26 via an associated ballasting capacitor 36, 38, 40, 42.

The inverter 12 includes analogous upper and lower, that is, first and second switches 44 and 46, for example, two n-channel MOSFET devices (as shown), serially connected between conductors 18 and 22, to excite the resonant circuit 14. It is to be understood that other types of transistors, such as p-channel MOSFETs, other field effect transistors, or bipolar junction transistors may also be so configured. The high frequency bus 26 is generated by the inverter 12 and the resonant circuit 14 and includes a resonant inductor 48 and an equivalent resonant capacitance that includes the equivalence of first, second, and third capacitors 50, 52, 54 and ballasting capacitors 36, 38, 40, 42 which also prevent DC current from flowing through the lamps 28, 30, 32, 34. Although they do contribute to the resonant circuit, the ballasting capacitors 36, 38, 40, 42 are primarily used as ballasting capacitors. The switches 44 and 46 cooperate to provide a square wave at a common first node 56 to excite the resonant circuit 14.

First and second gate drive circuits, generally designated 60 and 62, respectively include first and second driving inductors 64, 66 that are secondary windings mutually coupled to the resonant inductor 48 to induce a voltage in the driving inductors 64, 66 proportional to the instantaneous rate of change of current in the resonant circuit 14. First and second secondary inductors 68, 70 are serially connected to the first and second driving inductors 64, 66 and the gates of switches 44 and 46. The gate drive circuits 60, 62 are used to control the operation of the respective upper and lower switches 44, 46. More particularly, the gate drive circuits 60, 62 maintain the upper switch 44 "on" for a first half cycle and the lower switch 46 "on" for a second half cycle. The square wave is generated at the node 56 and is used to excite the resonant circuit. First and second bi-directional voltage clamps 71, 73 are connected in parallel to the secondary inductors 68, 70, respectively, each including a pair of back-to-back Zener diodes. The bi-directional voltage clamps 71, 73 act to clamp positive and negative excursions of gate-to-source voltage to respective limits determined by the voltage ratings of the back-to-back Zener diodes. Each bi-directional voltage clamp 71, 73 cooperates with the respective first or second secondary inductor 68, 70 so that the phase angle between the fundamental frequency component of voltage across the resonant circuit 14 and the AC current in the resonant inductor 48 approaches zero during ignition of the lamps.

Upper and lower capacitors 72, 74 are connected in series with the respective first and second secondary inductors 68, 70. In the starting process, the capacitor 72 is charged from the voltage terminal 18. The voltage across the capacitor 72 is initially zero, and during the starting process, the serially connected inductors 64 and 68 act essentially as a short circuit, due to the relatively long time constant for charging the capacitor 72. When the capacitor 72 is charged to the threshold voltage of the gate-to-source voltage of the switch 44 (e.g. 2-3 Volts), the switch 44 turns ON, which results in a small bias current flowing through the switch 44. The resulting current biases the switch 44 in a common drain, Class A amplifier configuration. This produces an amplifier of sufficient gain such that the combination of the resonant circuit 14 and the gate control circuit 60 produces a regenerative action that starts the inverter into oscillation, near the resonant frequency of the network including the capacitor 72 and the inductor 68. The generated frequency is above the resonant frequency of the resonant circuit 14. This produces a resonant current that lags the fundamental of the voltage produced at the common node 56, allowing the inverter 12 to operate in the soft-switching mode prior to igniting the lamps. Thus, the inverter 12 starts operating in the linear mode and transitions into the switching Class D mode. Then, as the current builds up through the resonant circuit 14, the voltage of the high frequency bus 26 increases to ignite the lamps, while maintaining the soft-switching mode, through ignition and into the conducting, arc mode of the lamps.

During steady state operation of the ballast circuit 10, the voltage at the common node 56, being a square wave, is approximately one-half of the voltage of the positive terminal 20. The bias voltage that once existed on the capacitor 72 diminishes. The frequency of operation is such that a first network 76 including the capacitor 72 and the inductor 68 and a second network 78 that includes the capacitor 74 and the inductor 70 are equivalently inductive. That is, the frequency of operation is above the resonant frequency of the identical first and second networks 76, 78. This results in the proper phase shift of the gate circuit to allow the current flowing through the inductor 48 to lag the fundamental frequency of the voltage produced at the common node 56. Thus, soft-switching of the inverter 12 is maintained during the steady-state operation.

The output voltage of the inverter 12 is clamped by serially connected clamping diodes 80, 82 of the clamping circuit 16 to limit high voltage generated to start the lamps 28, 30, 32, 34. The clamping circuit 16 further includes the second and third capacitors 52, 54, which are essentially connected in parallel to each other. Each clamping diode 80, 82 is connected across an associated second or third capacitor 52, 54. Prior to the lamps starting, the lamps' circuits are open, since impedance of each lamp 28, 30, 32, 34 is seen as very high impedance. The resonant circuit 14 is composed of the capacitors 36, 38, 40, 42, 50, 52, and 54 and the resonant inductor 48. The resonant circuit 14 is driven near resonance. As the output voltage at the common node 56 increases, the clamping diodes 80, 82 start to clamp, preventing the voltage across the second and third capacitors 52, 54 from changing sign and limiting the output voltage to a value that does not cause overheating of the inverter 12 components. When the clamping diodes 80, 82 are clamping the second and third capacitors 52, 54 the resonant circuit 14 becomes composed of the ballast capacitors 36, 38, 40, 42 and the resonant inductor 48. That is, the resonance is achieved when the clamping diodes 80, 82 are not conducting. When the lamps ignite, the impedance decreases quickly. The voltage at the common node 52 decreases accordingly. The clamping diodes 80, 82 discontinue clamping the second and third capacitors 52, 54 as the ballast 10 enters steady state operation. The resonance is dictated again by the capacitors 36, 38, 40, 42, 50, 52, and 54 and the resonant inductor 48.

In the manner described above, the inverter 12 provides a high frequency bus 26 at the common node 56 while maintaining the soft switching condition for switches 44, 46. The inverter 12 is able to start a single lamp when the rest of the lamps are lit because there is sufficient voltage at the high frequency bus to allow for ignition.

Figure 2:
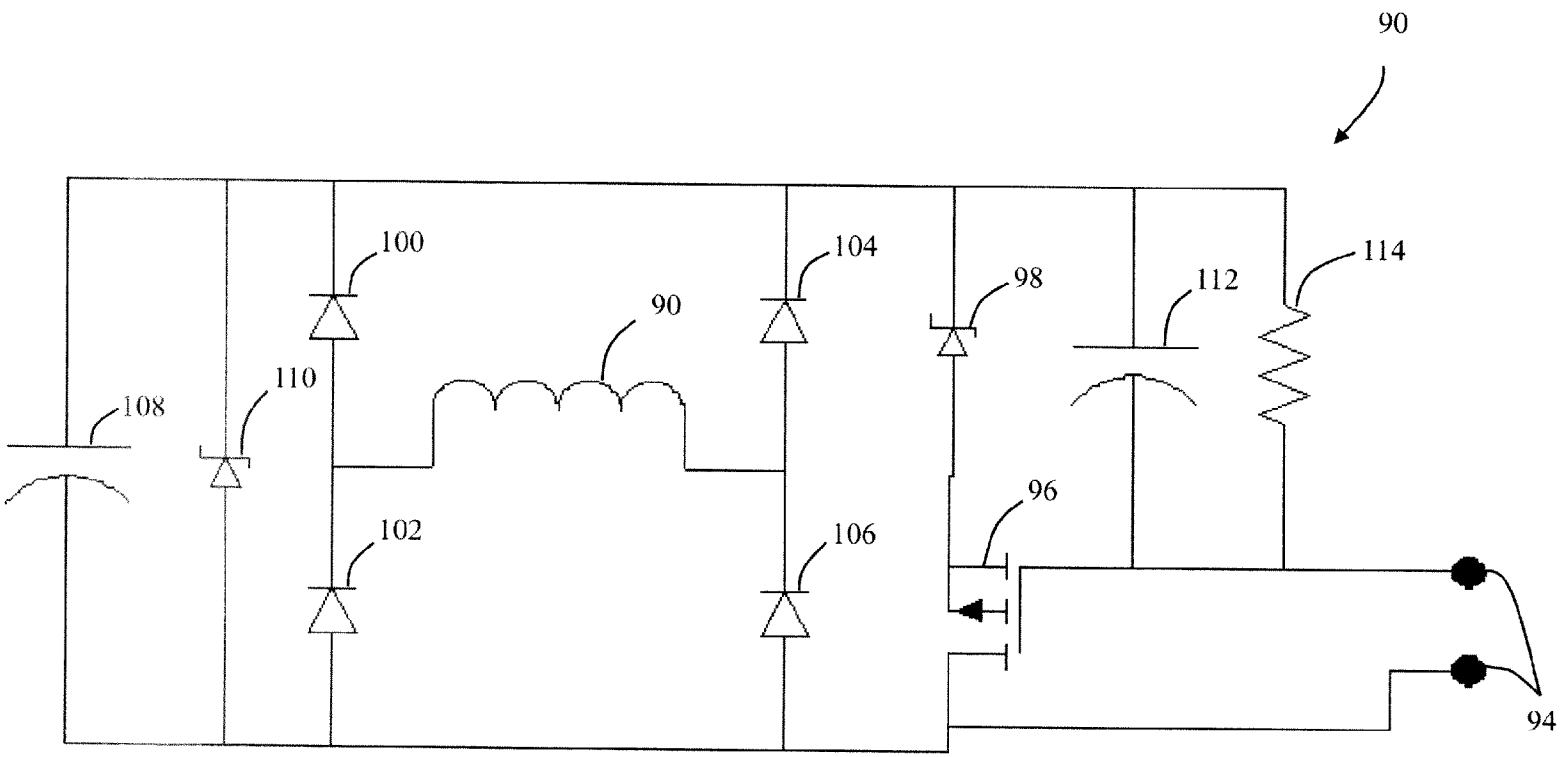
FIG. 2 is a circuit diagram of one particular embodiment of the interface circuit of FIG. 1.

An interface inductor 90 is coupled to the inductors 68 and 70. The interface inductor 90 provides an interface between an interface circuit 92 and the inverter 12. With reference now to FIG. 2, a continuous interface circuit is provided. An input is provided to the interface circuit across control leads 94. The external signal may be, for example, from 0 to 10 Volts. If the 10 Volts is applied, then the ballast 10 runs at 100%, whereas if a 0 Volt signal is applied, then the ballast 10 runs at the minimum value that does not require external cathode heating (about 50-60%), with dimming being continuous across the 0-10 volt input signal corresponding to 100%-50/60% of ballast operation.

More specifically, the interface inductor 90 is manipulated to change its apparent inductance. This, in turn, affects the operating frequency of the ballast 10, which is what dims the lamps, by reducing the power output to the lamps. A variable impedance is placed in parallel with the interface inductor 90 to manipulate its apparent inductance. The variable impedance is made up of a transistor 96 and a Zener diode 98. The control leads 94 are attached across the gate and drain of the transistor 96, controlling its conductivity, that is, its observed impedance. If no voltage is placed across the control leads 94 then the transistor 96 does not conduct and a very high impedance is seen in parallel with the interface inductor 90. As the voltage applied to the control leads 94 increases, so does the conductivity of the transistor 96, thereby lowering the impedance seen in parallel with the interface inductor. As the conductivity of the transistor 96 changes, so does the apparent load on the interface inductor 90.

Diodes 100, 102, 104, and 106 form a full wave bridge rectifier for converting the AC signal provided by inductors 68 and 70 into a DC signal. A capacitor 108 provides filtering for the interface circuit 92. A Zener diode 110 provides protection for startup purposes. Capacitor 112 and resistor 114 provide additional filtering for the interface signal.

Figure 3:
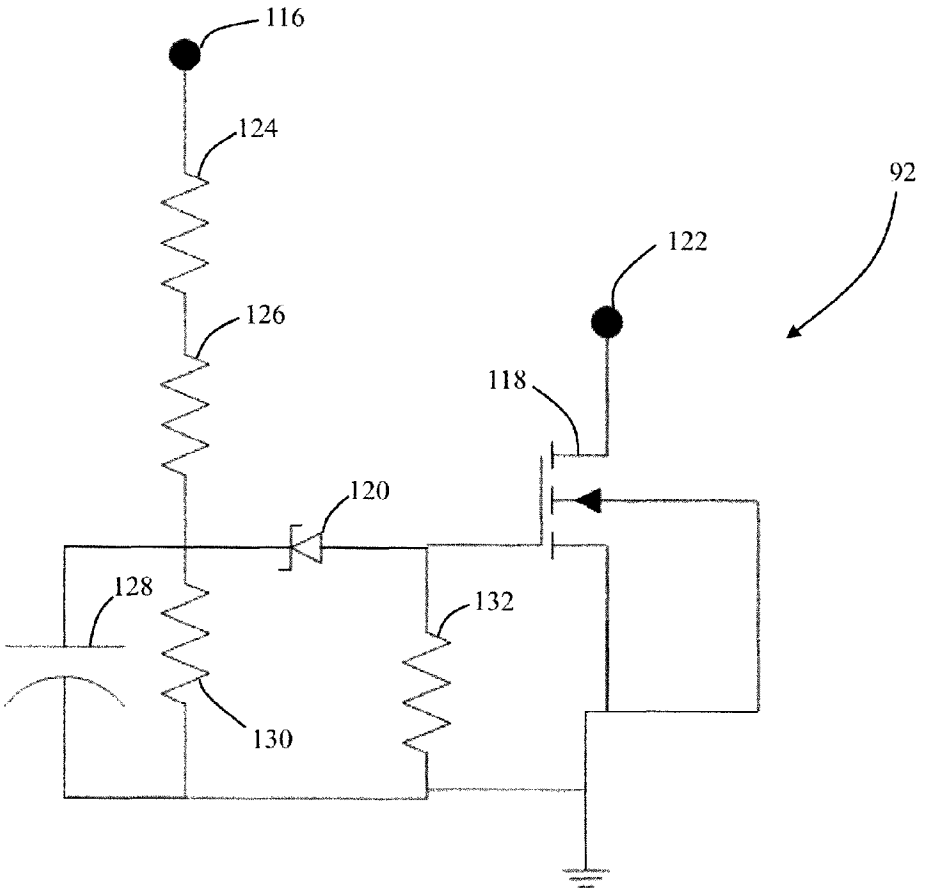
FIG. 3 is a circuit diagram of a second embodiment of the interface circuit of FIG. 1.

With reference now to FIG. 3, another embodiment of the interface circuit 92 is provided. In this embodiment, a single control lead 116 provides an input that is either on or off, which determines whether a transistor 118 is conductive or non-conductive. When the transistor 118 is conductive, then the interface circuit 92 is limited to the voltage of the Zener diode 120, forcing the ballast 10 into is lower output state. The additional input of the interface circuit 92 can be provided from node 122 to the inverter 12 via a high frequency bus controller inductively coupled to inductors 68, 70. One possible embodiment of the high frequency bus controller can be found in currently pending U.S. application Ser. No. 11/343,335 to Nerone, et al., at FIG. 3. Referring again to FIG. 3 of the present application, when the transistor 118 is not conductive, no additional interface signal is provided to the ballast 10, thus the ballast 10 runs at 100%. This embodiment provides step dimming. For example, the control lead 116 may be connected to a motion sensor. The lamps can come up to full when someone is present, but be dimmed at other times. Resistors 124 and 126 are selected to appropriately temper the voltage of the input signal from the control lead, and thus are dependent on the particular input source. Capacitor 128, resistor 130 and resistor 132 provide additional filtering to the interface circuit.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A dimming instant start lighting ballast circuit comprising:

first and second switches for receiving a direct current and converting it to an alternating current and providing the alternating current to at least one lamp each of the first and second switches having a gate and a source;

a first inductive winding connected between the gate and source of the first switch;

a second inductive winding connected between the gate and source of the second switch;

a resonant portion connected to the sources of the first and second switches that determines an operating frequency of the ballast; and an interface circuit that interfaces with the first and second inductive windings, the interface circuit receiving an input and controlling the light output of the at least one lamp, the interface circuit including:

an inductive winding coupled to the first and second inductive windings, and a third switch in parallel with the inductive winding that has a variable impedance.

2. The ballast circuit as set forth in claim 1, wherein the interface circuit further includes:

a Zener diode in series with the third switch.

3. The ballast circuit as set forth in claim 2, wherein the interface circuit further includes:

control leads connected to the gate and drain of the third switch that control the conductivity of the switch depending on the voltage applied to the control leads.

4. The ballast circuit as set forth in claim 3, wherein the voltage applied to the control leads varies from 0 to 10 Volts.

5. The ballast circuit as set forth in claim 3, wherein the voltage applied to the control leads is a binary signal.

6. A method of dimming a fluorescent lamp with an instant start ballast comprising:

providing a DC signal to the ballast;

converting the DC signal into an AC signal;

providing the AC signal to power at least one lamp; and varying the frequency of the AC signal to the at least one lamp with an interface circuit;

wherein the step of varying the frequency of the AC signal includes:

inductively coupling a winding of the interface circuit to windings of an inverter circuit of the ballast, and changing the apparent inductance of the winding of the interface circuit by:

placing a variable impedance in parallel with the winding of the interface circuit, and applying a control signal to the variable impedance that changes the conductivity of the variable impedance; and wherein the variable impedance includes:

a field effect transistor, and a Zener diode.

7. The method as set forth in claim 6, wherein the control signal is applied across the gate and drain of the field effect transistor.

8. An interface circuit for dimming an instant start ballast comprising:

a control winding for interfacing with the ballast;

a variable impedance in parallel with the control winding for changing the apparent inductance of the control winding;

control leads for inputting a control signal that changes the conductivity of the variable impedance;

a Zener diode for startup protection;

a rectifier for converting an AC signal to a DC signal; and smoothing circuitry for smoothing the DC signal;

wherein the variable impedance includes:

a field effect transistor in parallel with the control winding, and a Zener diode in series with the field effect transistor.

9. The interface circuit as set forth in claim 8, wherein the control signal is from 0 to 10 Volts.

10. The interface circuit as set forth in claim 8, wherein the control signal is a binary signal.

* * * * *